US008276339B2

(12) United States Patent
Von Limburg

(10) Patent No.: US 8,276,339 B2
(45) Date of Patent: Oct. 2, 2012

(54) DISTANCE PIECE

(75) Inventor: Felix Von Limburg, Magdeburg (DE)

(73) Assignee: B.T. Innovation GmbH, Magdeburg (DE)

( * ) Notice: Subject to any disclaimer, the term of this patent is extended or adjusted under 35 U.S.C. 154(b) by 41 days.

(21) Appl. No.: 12/586,173

(22) Filed: Sep. 17, 2009

(65) Prior Publication Data

US 2010/0071314 A1 Mar. 25, 2010

(30) Foreign Application Priority Data

Sep. 23, 2008 (DE) ..... 10 2008 048 425

(51) Int. Cl.
*E04B 2/00* (2006.01)

(52) U.S. Cl. ..... 52/418; 52/426; 52/479; 52/677

(58) Field of Classification Search ..... 52/783.1, 52/418, 419, 426, 479, 565, 677, 703, 707, 52/689

See application file for complete search history.

(56) References Cited

U.S. PATENT DOCUMENTS

| | | | | | |
|---|---|---|---|---|---|
| 2,842,145 | A | * | 7/1958 | Wilson, Jr. | 135/100 |
| 3,042,052 | A | * | 7/1962 | Des Rosier | 135/100 |
| D196,019 | S | * | 8/1963 | Mayer | D7/334 |
| 3,215,097 | A | * | 11/1965 | Bedol | 108/159 |
| 4,240,233 | A | * | 12/1980 | Vercelletto | 52/127.3 |
| 4,423,849 | A | * | 1/1984 | Jordan | 248/165 |
| 4,483,119 | A | | 11/1984 | Hernandez | |
| 4,705,250 | A | * | 11/1987 | Eastman | 248/164 |
| 4,742,659 | A | * | 5/1988 | Meilleur | 52/309.12 |
| 5,177,928 | A | * | 1/1993 | Fricker | 52/707 |
| 5,390,459 | A | * | 2/1995 | Mensen | 52/426 |
| 5,570,552 | A | * | 11/1996 | Nehring | 52/426 |
| 5,606,832 | A | * | 3/1997 | Keith et al. | 52/410 |
| 5,876,091 | A | * | 3/1999 | Chernomashentsev | 297/16.2 |
| 6,146,050 | A | * | 11/2000 | Marshall | 403/400 |
| 6,182,650 | B1 | * | 2/2001 | Tuttle | 126/30 |
| 6,308,484 | B1 | * | 10/2001 | Severino | 52/426 |
| 7,266,931 | B2 | * | 9/2007 | Long, Sr. | 52/426 |
| 7,384,097 | B2 | * | 6/2008 | Park et al. | 297/45 |
| 7,861,479 | B2 | * | 1/2011 | Crosby et al. | 52/426 |
| 2004/0177580 | A1 | * | 9/2004 | Tremelling | 52/426 |

FOREIGN PATENT DOCUMENTS

| | | | |
|---|---|---|---|
| DE | 1 943 592 | U | 8/1966 |
| DE | 7139594 | U | 4/1972 |
| DE | 7239182 | U | 1/1973 |
| DE | 76 32 166 | U1 | 1/1977 |
| DE | 38 03 214 | A1 | 8/1989 |
| DE | 10 2007 014 366 | A1 | 10/2008 |
| WO | WO 98/59129 | | 12/1998 |
| WO | WO 2006098800 | A1 * | 9/2006 |

* cited by examiner

*Primary Examiner* — Branon Painter
(74) *Attorney, Agent, or Firm* — Flynn, Thiel, Boutell & Tanis, P.C.

(57) ABSTRACT

Distance piece, preferably for the manufacture of hollow or laminated walls, with at least three rods that are connected to each other, and where each rod has at least one supporting section, and the supporting sections of the three rods are spaced apart from each other to thus form a supporting plane.

17 Claims, 4 Drawing Sheets

DISTANCE PIECE

The present invention relates to a distance piece, preferably for the manufacture of hollow wall panels or laminated wall panels.

Such distance pieces are generally known from prior art and are also referred to as anchors. They usually consist of a metal rod essentially bent in a U-shape that extends between two spaced wall panels of a hollow wall panel or a laminated wall panel. In the case of hollow wall panels, the wall panels are spaced apart. In case of laminated wall panels, an insulation layer is located between the wall panels. Such laminated wall panels are also referred to as a sandwich wall. Moreover, there are combined forms where a hollow wall panel also comprises insulation between the wall panels. In most cases, the wall panels consist of concrete. The hollow wall panel is manufactured in a well-known manner. First, a formwork is placed onto a formwork support, then the reinforcing rods of steel or the like are inserted where applicable, and subsequently the formwork is filled with concrete. While the concrete is still liquid, the U-shaped distance piece is inserted into the concrete with one of its legs and positioned. Preferably, several distance pieces are provided to thereby realize a stable connection between the wall panels. After setting, the formwork is removed, so that a finished wall panel is formed from which the distance piece, preferably several distance pieces, at least partially protrude. Subsequently, a second formwork is arranged on a formwork support. Into this formwork, too, reinforcement mats, reinforcing rods and the like can be possibly introduced to reinforce the wall panel. Subsequently, the second mold is also filled with concrete. While the concrete is still liquid, the already finished first wall panel is lifted and turned and positioned such that it is arranged above and at a distance to the second wall panel to be fabricated, where the other leg of the U-shaped distance piece immerses into the concrete of the second wall panel to be fabricated. This procedure is also referred to as turning. After the concrete has set, the second formwork can be removed. In this manner, a hollow wall panel has been produced which consists of two spaced wall panels that extend essentially in parallel to each other and are connected via the distance pieces. In case of laminated wall panels, an insulation layer which is penetrated by the distance piece is applied after the manufacture of the first wall panel.

The distance pieces cannot only be used for positioning the wall panels at a distance, but also for lifting the hollow wall panel on-site. A lifting device, e.g. a crane, can engage in one or several ones of the distance pieces, so that the hollow wall panel can be lifted and brought to the desired place on-site. As soon as the hollow wall panel has reached its final position, for example to form a hollow wall in connection with several other hollow wall panels, the same can be filled with cast-in-place concrete and/or insulation materials as is well-known. The advantage of such hollow wall panels is their easy handling and their comparably low weight. Moreover, the manufacture of walls on-site is facilitated as the hollow wall panels simultaneously serve as formwork for the filling material applied between the wall panels, such as e.g. cast-in-place concrete. Moreover, these hollow wall panels permit very cheap industrial prefabrication. Thereby, the costs for constructing buildings can be considerably reduced.

However, it showed in operation that the pull out resistance of the distance pieces is not ensured at all times. Damages to the wall panels are often insufficiently repaired on-site, having detrimental consequences for the strength of the wall panel. It also showed that the accuracy in the fabrication of such hollow panels does not always correspond to the desired requirements. This also applies to laminated wall panels.

It is therefore the object of the invention to improve distance pieces of the type mentioned in the beginning, such that, on the one hand, the strength of the hollow wall panels or laminated wall panels to be manufactured can be improved, and on the other hand the accuracy of manufacture can be increased.

According to the invention, this object is achieved by a distance piece of the type mentioned in the beginning, with at least three rods that are connected to each other, and where each rod comprises at least one supporting section, and where the supporting sections of the three rods are spaced apart to thus form the supporting plane.

This solution is simple and advantageous in that by forming a supporting plane, the distance pieces can be used to position the wall panels more accurately with respect to each other. During the manufacture of the first wall panel, the distance piece can, e.g., be immersed far enough into the liquid concrete to contact the formwork support. After the setting and turning of the first wall panel in the formwork of the second wall panel, the precise distance of the first wall panel to the second wall panel can be determined by means of the distance piece. By a distance piece now comprising at least three rods, the pull out resistance can be moreover clearly improved compared to well-known distance pieces. For example, the number of required distance pieces for manufacturing a hollow wall panel can thus be reduced. Moreover, by the novel distance piece, forces in parallel to the wall panels can be also better taken up. This is in particular advantageous in the case of laminated wall panels, where a facade can be formed from the wall panels.

A particular simple distance piece can be obtained if the three rods are essentially straight.

It can moreover prove to be advantageous if at least two of the three rods, preferably the three rods, include a preferably acute angle $\alpha$. By this design, the pull out resistance of the distance piece can be clearly increased.

A simple design of the distance piece can be achieved if the supporting sections of the rods are formed by their end sections.

It can also prove to be advantageous to firmly connect the rods to each other. Thereby, the overall stiffness of the distance piece can be improved.

To obtain a unit of the distance piece as compact and stiff as possible, it is advantageous for at least two—preferably three—of the rods to contact each other.

Furthermore, it can prove to be advantageous for at least one rod, preferably all rods, to comprise at least two supporting sections which are formed by end sections that are located opposite to each other. Thereby, one can on the one hand realize a particularly simple design of the distance pieces and, on the other hand, two supporting planes that are located opposite to each other can be obtained in this manner. It can in this case be advantageous if the supporting planes are in parallel to each other. Then, the distance piece can be employed more versatiley. In particular, this permits to accurately adjust the distance of two wall panels, as the distance piece can be inserted into liquid concrete on both sides until it touches the formwork support. Thereby, an exact positioning of the two wall panels with respect to each other can be realized with only little effort.

To improve the strength of the distance piece, a connection arrangement can be provided which connects the three rods with each other.

It can therefore be advantageous for the connection means to comprise a ring through which the rods extend. Thus, in a particularly simple manner, a stable unit can be realized. The ring can also have a shape that is different from the geometry of an exact ring, however, it should completely surround the rods.

It can be advantageous for the ring to be arranged at the rods approximately centrically in the longitudinal direction of the rods. A constriction can be generated by the ring which permits to position in particular a hook of a crane approximately centrically between the wall panels if the hollow wall panels are to be lifted. To increase strength, the ring can be firmly connected to the rods.

In an advantageous further development of the invention, the rods can be made of high-grade steel. The advantage of high-grade steel is that it does not get rusty. Thereby, it is possible to press the distance piece into liquid concrete down to the formwork support. Though the distance piece is then visible at the finished wall panel, there is, on the other hand, no risk of rust compared to conventional distance pieces.

To increase strength, it can be furthermore advantageous for the ring to comprise metal or preferably to consist of metal.

In an alternative embodiment, the rods and/or the ring can consist of plastics, preferably glass-fiber reinforced plastics (GFRP). Carbon fiber materials are also conceivable. The advantage of a distance piece of plastics is that it can be also pressed into the liquid concrete until its supporting sections contact the formwork. It is true that the distance piece is then visible at the finished hollow or laminated wall panel from outside; on the other hand, no thermal bridges are formed by the use of plastics. Moreover, there is no risk of rust.

In a second embodiment of the invention, the distance piece can comprise at least four rods. Thereby, the strength of the distance piece can be further increased.

It can in this case be advantageous for the rods to be spaced apart. Then, one can also obtain better strength.

In such an embodiment, the connection means can extend between the rods. Unlike in the embodiment with a connection element gripping around the rods, the connection element can here be placed between the rods to thus space the rods apart as far as possible.

If four rods are used, the connection means can preferably extend essentially crosswise between the rods and connect the rods with each other.

In one advantageous further development of the invention, the connection means can be arranged to be shifted in the longitudinal direction of the rods with respect to the center of the rod, however between the end sections of the rods. In this manner, it is possible to shift the connection means into one of the wall panels, so that the connection means is not or only partially visible at the finished hollow or laminated wall panel. Thereby, the resistance of the distance pieces against being pulled out of a wall panel can be increased.

In such a design, the distance of the end sections of the rod can be larger on one side of the connection means than on the other side.

In an advantageous further development of the invention, the distance between the end sections which are closer to the connection means can be smaller than the distance between the end sections which are further apart from the connection means. In particular, in hollow wall panels, the wall panels of which comprise different thicknesses, such an embodiment can prove to be advantageous, especially in the case of laminated wall panels where the thick wall panel takes over the supporting function and the thin wall panel serves as a facade.

Furthermore, it can prove to be advantageous for the rods to be arranged essentially on the surface of a frustum of a pyramid. One can advantageously design the distance pieces to be symmetric, whereby the force progression can be symmetrically introduced into the distance piece, so that the strength of the hollow or laminated wall panels can be increased. In an alternative embodiment, a geometric embodiment can be realized which corresponds to two pyramids or tetrahedrons which are facing each other, the apex of which is essentially arranged in the region of the connection means. In such embodiments, it can be advantageous for all rods to have the same length to generate such geometric arrangements In a further advantageous embodiment, the distance piece with rods and connection means can be made in one piece, preferably by injection molding.

Furthermore, it can prove to be advantageous for the rods to comprise fixing profiles or for their surface to be profiled. This can also increase the pull out resistance.

It can prove to be advantageous for the rods to be sharpened or beveled at the end sections. Thereby, positioning accuracy can be improved.

Furthermore, a hollow or laminated wall panel is protected which comprises at least two spaced wall panels, at least one of which preferably comprises concrete, and between which a distance piece according to the invention extends at least in sections.

For lifting the hollow or laminated wall panels, the connection means can be arranged between the wall panels.

It can also be advantageous for the connection means to be arranged in one of the wall panels at least in sections. It can also prove to be advantageous for at least one supporting plane to be arranged in a plane of an external wall of a wall panel.

Furthermore, a method for manufacturing a hollow or laminated wall panel is protected, the wall panel comprising at least two spaced wall panels between which at least one distance piece according to the invention extends, where the distance piece, during the manufacture of at least one of the wall panels, is at least indirectly or preferably directly placed against a form work support on which the wall panel to be manufactured is located.

The invention will be described below with reference to the following figures, wherein FIG. 1 shows a first embodiment of a distance piece according to the invention in a perspective representation;

Figure 1:
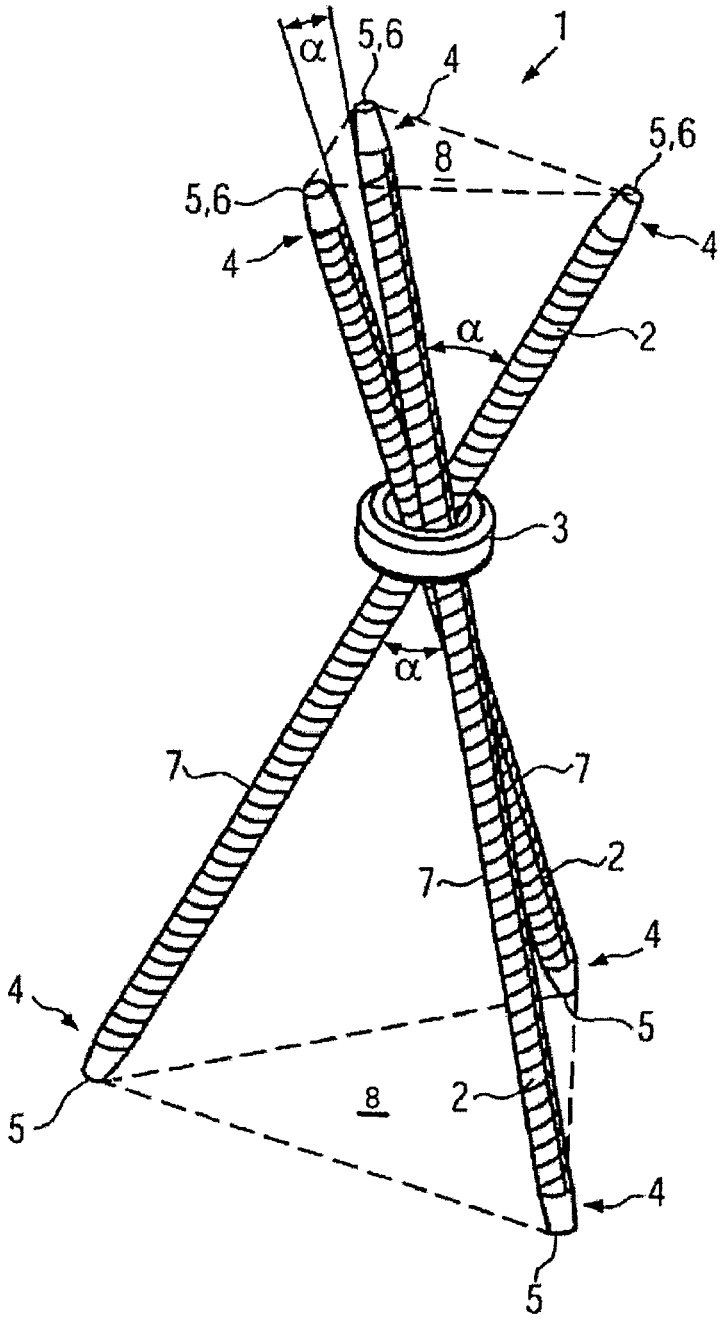
Figure 2:
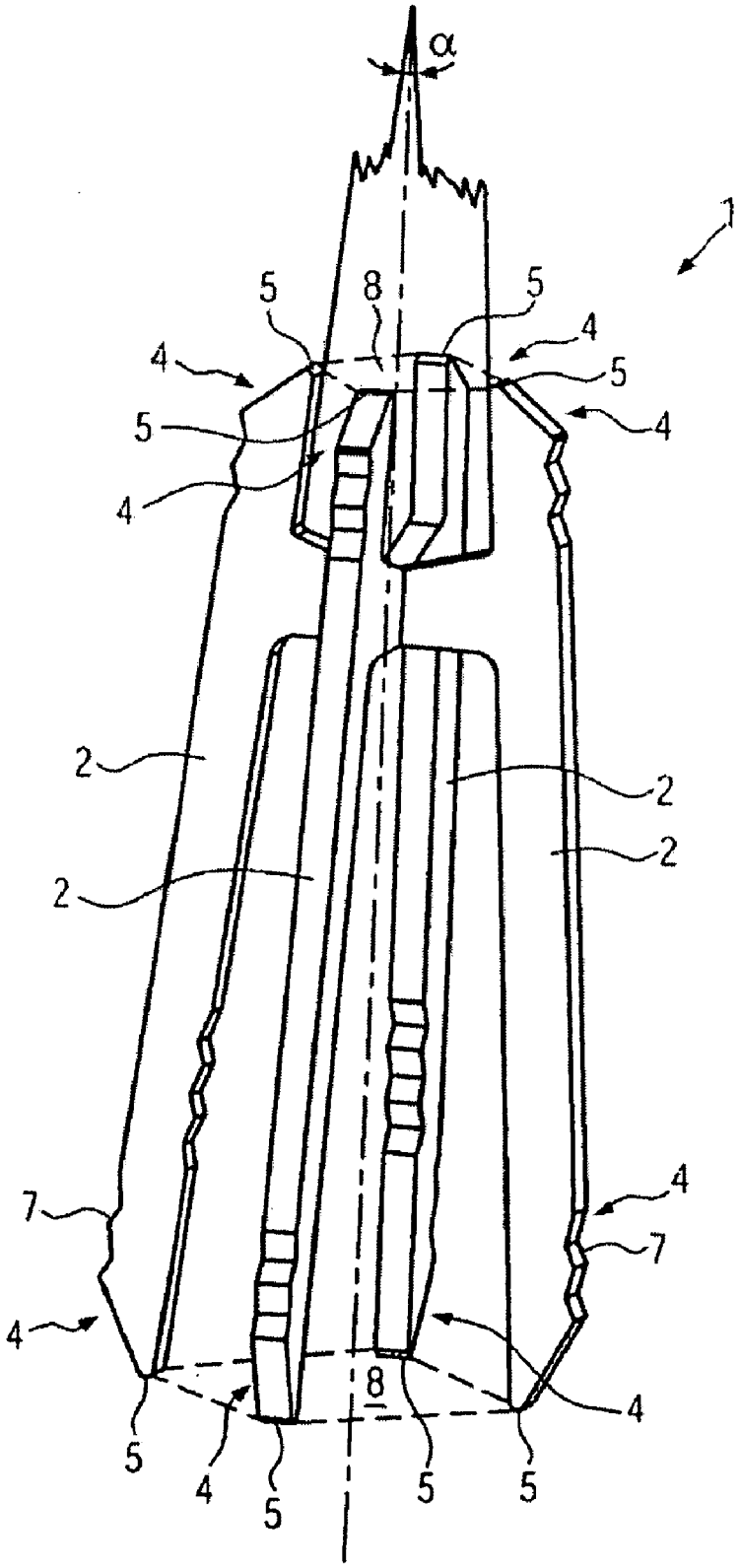
FIG. 2 shows a second embodiment of a distance piece according to the invention in a perspective representation.

FIG. 1 shows a distance piece 1 according to the invention comprising three rods 2. The rods extend through a connection means 3 embodied as a ring. The rods 2 are here arranged with respect to each other such that all three rods contact each other in the region of the connection means 3. The connection means 3 is firmly connected with the rods 2. Each rod comprises two end sections 4 at opposite ends which form supporting sections 5. Each of the end sections 4 slightly tapers, that means they are sharpened, and comprise disk-shaped front faces 6. Each of the rods comprises a spiral profiling 7.

Figure 5:
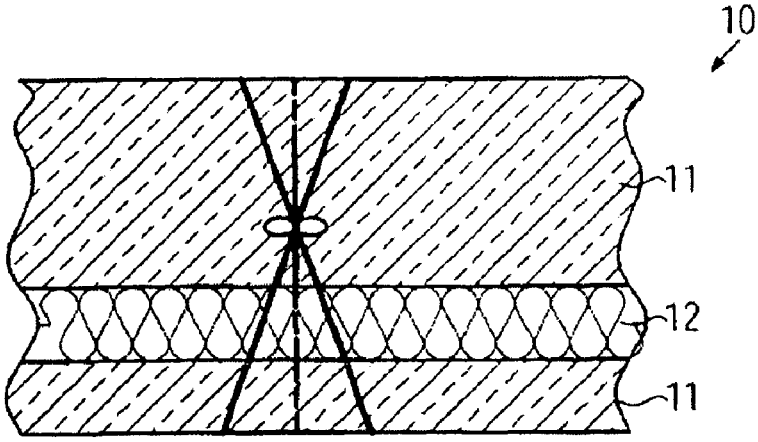
FIG. 5 shows a schematic sectional view of an embodiment of a laminated wall panel with a distance piece of the first embodiment.

As becomes clear in FIG. 1, the connection means 3 is arranged essentially centrically in the longitudinal direction of one of the rods. FIG. 5 shows an embodiment where the connection means is shifted towards an end section of a rod. Thereby, the distance from the end section of the rods 2 to the ring or the connection means 3, respectively, is different in each case. All rods essentially have the same length, and two of the rods each include an acute angle $\alpha$ of about 10-30°. Thereby, the supporting sections 5 of the rods are each spaced apart, so that they form supporting planes 8. The supporting planes 8 are shown in a broken line. In the representation in FIG. 1, the supporting planes are formed by three supporting sections 5 on one side of each of the connection means 3. These supporting planes are arranged in parallel to each other. Essentially, three supporting sections together with the region where the three rods are in contact are located essentially within a tetrahedron, where due to the arrangement of the rods on both sides of the connection means, the rods are arranged within two tetrahedrons whose apexes face each other. In other words, the distance piece 1 forms a tripod at each side of the connection means, where the supporting sections 5 are provided for standing on a formwork support 9.

As materials for the distance piece 1, stainless steels, e.g. high-grade steel, are suited. It is particularly preferred to fabricate the rods of plastics, preferably of glass-fiber reinforced plastics. Alternatively, carbon fiber reinforcements are also conceivable. In particular, plastics are suited which can be processed in the course of an injection molding process. The annular connection means 3 can be made of any metal. Preferably, however, the same materials as for the rods 2 can be employed.

Figure 3:
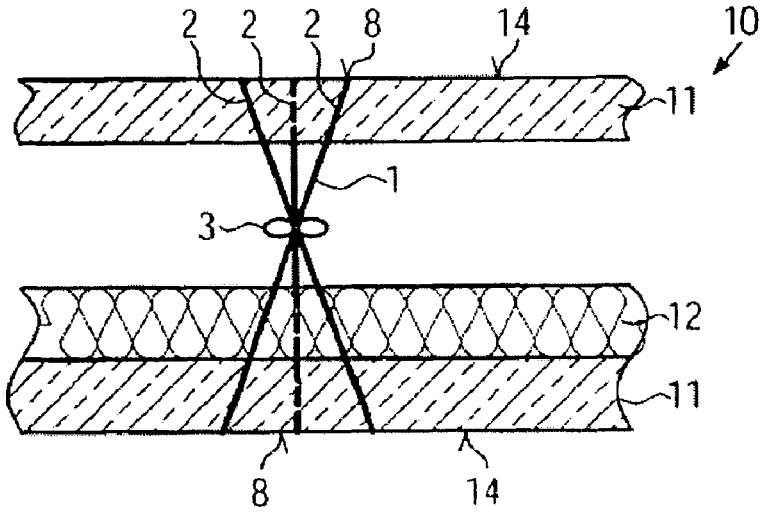
FIG. 3 shows a schematic representation of a hollow wall panel with a distance piece according to the invention of the first embodiment.

FIG. 3 shows a distance piece according to the invention as it is installed. For this, a hollow wall panel 10 is schematically shown in a sectional view, where the distance piece is also drawn schematically. The portion that is not visible in the sectional view is drawn in a broken line. The hollow wall panel 10 consists of two wall panels 11 that are spaced apart and between which a hollow space is arranged. Insulation material is inserted in this hollow space, for example at one of the wall panels. While the wall panels 11 are preferably made of concrete, the insulation can consist, e.g., of polystyrene, foam or glass wool and the like.

The distance piece 1 is firmly connected to the wall panels 11, in particular, it is poured in.

The manufacture of such a hollow wall panel 10 is illustrated with reference to FIGS. 7, 8 and 9 by way of example.

First, a formwork 13 is located on the formwork support 9, the formwork being essentially designed like a frame with internal dimensions of ca. 2.5×2.5 m. First, in a well-known manner, reinforcement mats and reinforcing rods are placed into this formwork 13 so as to cross each other, if they are required. Subsequently, the formwork 13 is filled with concrete as is represented in FIG. 7. The distance piece 1 is placed into the still liquid concrete so as to stand on the formwork support 9 with its supporting sections 5. Thereby, the distance piece 1 is standing upright on the formwork support 9, where the corresponding supporting plane essentially corresponds to the outer surface of the wall panel after it has been finished.

After the setting of the concrete, the formwork 13 is removed. Next, a second wall panel 11 is manufactured by placing another formwork 13, or the same formwork 13, onto the formwork support 9. In a well-known manner, the reinforcing rods or the reinforcement mats are inserted if they are required. Next, concrete is added. Now, the first wall panel is turned into the second wall panel, as is represented in FIG. 8, lifted at the distance pieces and transferred to a non-depicted suction turner which holds the wall panel at its short side. Subsequently, the first wall panel 11 is turned and the protruding distance piece 1 is pressed into the concrete with its other supporting sections so that it comes into contact with the formwork support 9. Then, the configuration as shown in FIG. 8 is obtained. After setting, the formwork 13 is removed, so that a hollow wall panel according to FIG. 9 is formed.

Basically, several distance pieces are provided, so that a fixed connection between the opposite wall panels 11 is formed. On the site where a building is completed, the hollow wall panel can now be positioned at the desired place. Subsequently, the hollow space is filled with concrete or the like.

By the use of the distance piece according to the invention, on the one hand, a high pull-out resistance is ensured as it is not possible to pull out the distance piece 1 thanks to the rods 2 being arranged obliquely with respect to each other. By the great insertion depth, a fixed connection is achieved. At the same time, it is possible to press the distance piece into the still liquid concrete of the second wall panel during turning, where the reinforcement mats, reinforcing rods, can be slightly shifted. Moreover, the distance piece is designed such that it positions the two wall panels accurately with respect to each other after turning, where the supporting surfaces are essentially located in the plane of the outer surfaces 14 of the wall panels. If several spaced distance pieces 1 are used, a high degree of parallelism of the wall panels 11 with respect to each other is simultaneously ensured.

In the embodiment in FIG. 3, the connection means is located to be essentially visible between the wall panels. Thereby, it is easily possible to attach a hook there to be able to lift the hollow wall panel. The distance piece 1 in FIG. 3 is thinnest in the region of the connection means 3.

In FIG. 5, an alternative embodiment is described where the connection means is arranged to be shifted towards one side of the distance piece 1. It is thereby possible for the connection means to completely disappear in the concrete of one of the wall panels. In the embodiment in FIG. 5, one of the wall panels is thicker than the other wall panel. The hollow space between the wall panels 11 is here filled with insulation material. Such hollow wall panels are referred to as so-called laminated or sandwich wall. For the manufacture, an insulation material is applied onto the first wall panel. The distance piece is pushed through the insulation material and pressed into the liquid concrete. Subsequently, the second wall panel is poured. The turning process is omitted. The thick wall panel serves as the wall and the thin wall panel as a facade.

Next, a second embodiment of the invention is illustrated more in detail, where the same components are provided with the same reference numerals. Only differences between the first and the second embodiments are discussed.

The distance piece 1 of the second embodiment comprises four rods 2. Basically, it is also conceivable to design such a distance piece with three rods or with several rods. Unlike in the first embodiment, the connection means 3 is arranged between the rods. The connection means 3 here has an essentially cross-like design and connects the rods 2 with each other. Moreover, the connection means 3 is clearly shifted towards one side of the rods, so that the distance from the end section to the connection means is greater on one side of a rod than on the other side.

The arrangement of the rods is made in the form of a frustum of a pyramid. That means, the end sections are located to be closer to each other on the one side of the rods than on the other side. In particular, the end sections or the supporting sections 5 are located closer to each other on the side of the connection means that is arranged closer to the connection means than on the side of the rods that is further apart from the connection means 3.

Furthermore, the rods are not round but designed with a rectangular or square cross-section. In the region of the end sections, they are beveled each. They furthermore have serrated profiles 7 at the outer surface.

The rods 2 and the connection means 3 are essentially made in one piece and are in particular made of plastic. Glass-fiber reinforced plastics or carbon fiber reinforced plastics can be used as suitable plastics.

Figure 4:
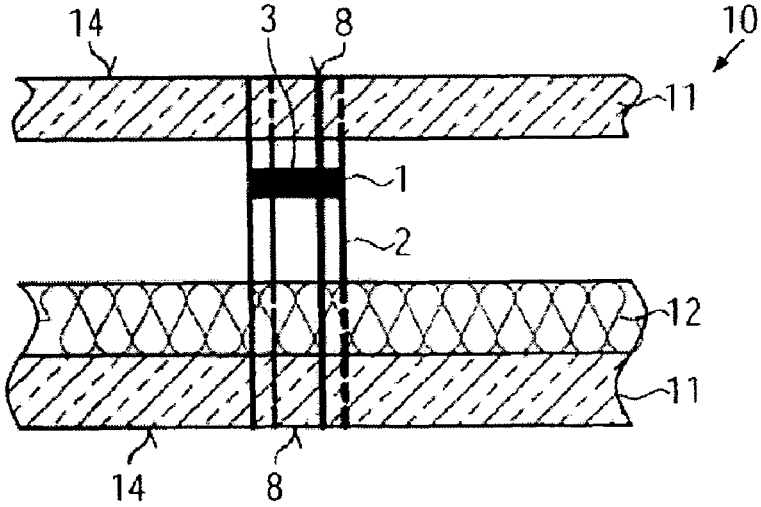
FIG. 4 shows a schematic sectional view of a hollow wall panel with a distance piece according to the invention of the second embodiment.
Figure 6:
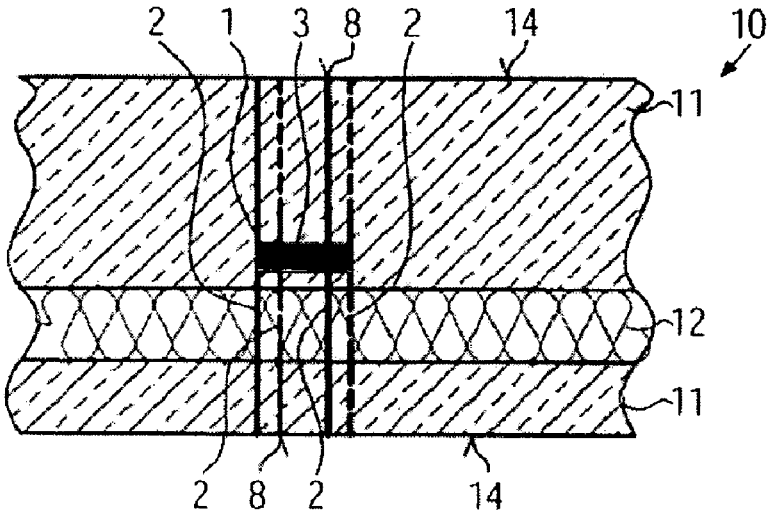
FIG. 6 shows a schematic sectional view of an embodiment of a laminated wall panel with a distance piece according to the second embodiment.

FIG. 4 shows a hollow wall panel 10 and FIG. 6 shows a laminated wall panel (sandwich panel) with distance pieces according to the second embodiment. In case of the representation in FIG. 4, the connection means 3 is located between the wall panels 11, and in case of FIG. 6, the connection means 3 is located within the thicker wall panel.

By the rods 2 all having the same length and moreover by opposite rods including an acute angle $\alpha$ of ca. 5-10°, two supporting planes 8 arranged in parallel to each other are formed by the supporting sections 5.

Figure 7:
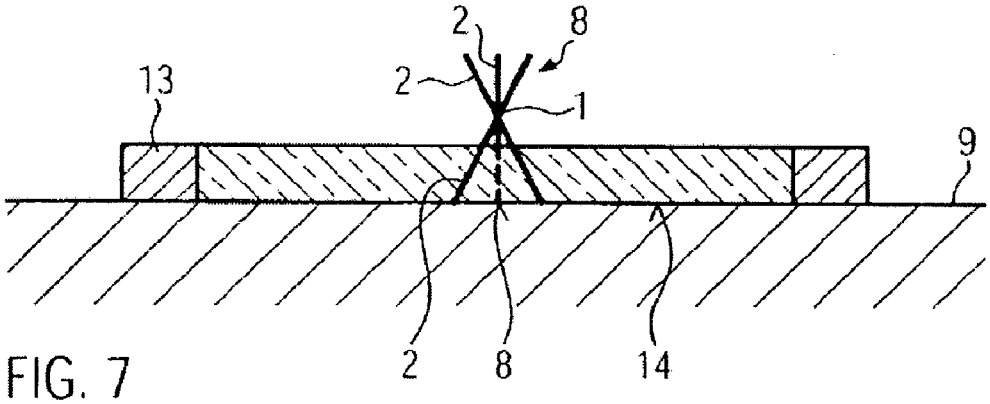
FIGS. 7 to 9 show the sequence of the manufacture of a hollow wall panel in a schematic sectional view.
Figure 8:
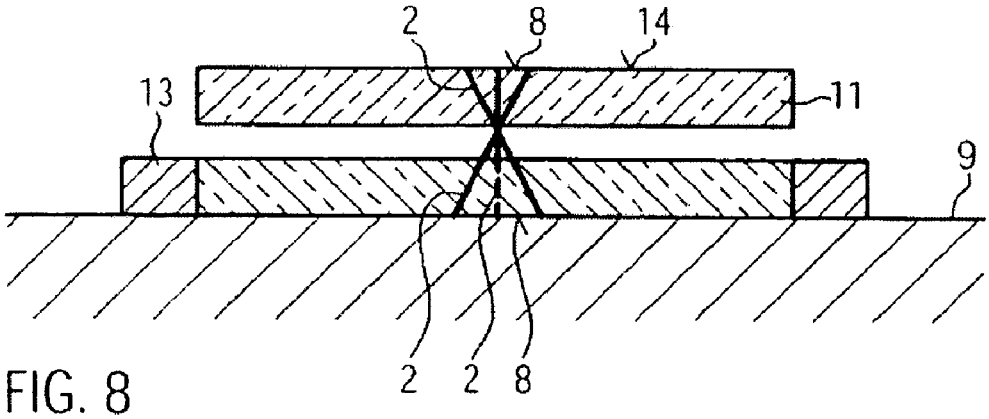
Figure 9:
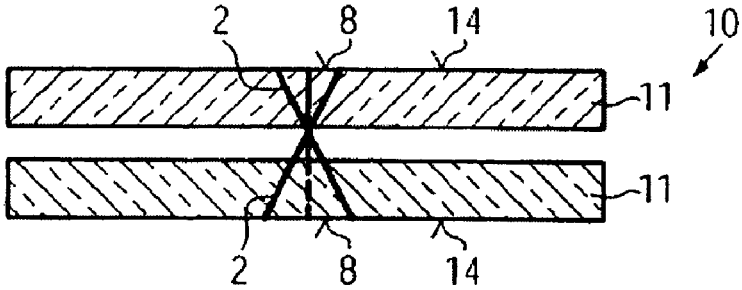

The manufacture of a hollow wall panel 10 is accomplished in the same manner as was realized in FIGS. 7, 8 and 9 in connection with the first embodiment. With the distance piece according to the second embodiment, moreover, the same advantages are achieved, that is a simple and inexpensive manufacture of the distance piece, high pull out resistance and accurate positioning. In the second embodiment, too, the supporting planes are each positioned essentially in the plane of the outer surface of the wall panels.

Basically, it is also conceivable for the supporting sections 5 to be arranged within the wall panels 11 such that they cannot be seen from the outside. However, those embodiments are preferred where the supporting sections 5 are each standing on the formwork support 9 during the manufacture to thus position the wall panels accurately with respect to each other.

LIST OF REFERENCE NUMERALS

1 Distance piece
2 Rod
3 Connection means
4 End section
5 Supporting section
6 Front face
7 Profiling
8 Supporting plane
9 Formwork support
10 Hollow wall panel
11 Wall panel
12 Insulation
13 Formwork
14 Outer surface

The invention claimed is:

1. A hollow or laminated wall comprising at least two spaced wall panels, at least one of said wall panels comprising concrete, between which a distance piece at least partially extends, the distance piece comprising at least three rods, each rod comprising at least two supporting sections formed by first and second opposite ends of the rod, the rods being firmly connected to each other at a portion which is spaced apart from the opposite ends of the rods, the supporting sections of the rods being spaced apart from each other to thus form two supporting planes which are located near opposite rod ends to each other, the first ends of the at least three rods defining a first plane and the second ends of the at least three rods defining a second plane, the rods being provided at acute angles to one another and at least two of the rods being in contact with each other.

2. The hollow or laminated wall according to claim 1, characterized in that the distance piece is arranged between the wall panels.

3. The hollow or laminated wall according to claim 1, characterized in that the distance piece connection means is arranged in one of the wall panels at least in sections.

4. The hollow or laminated wall according to claim 1, characterized in that at least one supporting plane is arranged in a plane of an outer surface of a wall panel.

5. The hollow or laminated wall according to claim 1, characterized in that the at least three rods are essentially straight.

6. The hollow or laminated wall according to claim 1, characterized in that the supporting planes are parallel to each other.

7. The hollow or laminated wall according to claim 1, characterized in that a connection means is provided for connecting the rods to each other.

8. The hollow or laminated wall according to claim 7, characterized in that the connection means comprises a ring through which the rods extend.

9. The hollow or laminated wall according to claim 8, characterized in that the ring is arranged at the rods approximately centrically in the longitudinal direction of the rods.

10. The hollow or laminated wall according to claim 8, characterized in that the ring is firmly connected to the rods.

11. The hollow or laminated wall according to claim 8, characterized in that the ring comprises a metal.

12. The hollow or laminated wall according to claim 7, characterized in that the distance of the first ends of the at least three rods from one another is smaller and closer to the connection means than the distance of the second ends of the at least three rods from one another, which are at a further distance from the connection means.

13. The hollow or laminated wall according to claim 1, characterized in that the rods comprise a metal.

14. The hollow or laminated wall according to claim 1, characterized in that the rods or the ring comprise a plastic.

15. The hollow or laminated wall according to claim 1, characterized in that the rods essentially form the edges of a pyramid-shaped arrangement.

16. The hollow or laminated wall according to claim 1, characterized in that the rods comprise fixing profiles.

17. The hollow or laminated wall according to claim 1, characterized in that the rods are sharpened or beveled at their ends.

* * * * *